US006099413A

United States Patent [19]

Naylor

[11] Patent Number: 6,099,413

[45] Date of Patent: Aug. 8, 2000

[54] PUTTER WITH SHROUDED STRIKING FACE

[76] Inventor: Ronald A. Naylor, 1815 Anderson Ave., Ann Arbor, Mich. 48104

[21] Appl. No.: 09/282,265

[22] Filed: Mar. 31, 1999

[51] Int. Cl.[7] ..... A63B 53/04; A63B 69/36

[52] U.S. Cl. ..... 473/226; 473/251; 473/340; 473/330

[58] Field of Search ..... 473/251, 249, 473/236, 219, 228, 223, 340, 313, 330, 328, 226; D21/736–746

[56] References Cited

U.S. PATENT DOCUMENTS

| | | |
|---|---|---|
| D. 222,889 | 1/1972 | Dziurgot . |
| 837,030 | 11/1906 | Blanchard . |
| 1,546,612 | 7/1925 | Barnes . |
| 1,678,750 | 7/1928 | Swan . |
| 2,620,186 | 12/1952 | Beeaff, Jr. . |
| 3,333,854 | 8/1967 | White . |
| 3,595,582 | 7/1971 | Chapman . |
| 4,002,343 | 1/1977 | Eckert . |
| 4,165,076 | 8/1979 | Cella . |
| 4,720,109 | 1/1988 | Kryter . |
| 5,390,920 | 2/1995 | Nickum . |
| 5,467,987 | 11/1995 | Perkins . |
| 5,551,695 | 9/1996 | Wolk . |

*Primary Examiner*—Sebastiano Passaniti
*Attorney, Agent, or Firm*—Harness, Dickey & Pierce, P.L.C.

[57] ABSTRACT

A golf putter having an upright shaft and a putter head at the lower end of the shaft, the putter head consisting of a body having a flat striking face extending in a generally vertical plane transversely of the shaft and having at the upper end of the face a forwardly extending shroud which hides the striking face but not so far as to totally hide a golf ball when engaged by a user of the putter during a putting stroke. The shroud terminates at its forward edge which is of arcuate shape when looking down on the body which is the view seen by a golfer executing a conventional stroke of the putter, the view enhancing the tendency of the putter to perform straight movement through the ball in use and on a straight line with the exact middle of the striking face striking the ball because the center of the arcuate edge.

5 Claims, 2 Drawing Sheets

PUTTER WITH SHROUDED STRIKING FACE

BACKGROUND AND SUMMARY OF THE INVENTION

This invention relates generally to the popular game of golf wherein accurate putting is one of the most important aspects of the game. More particularly, this invention relates to a golf putter having an upright shaft and a putter head at the lower end of the shaft, the putter head consisting of a body having a flat striking face extending in a generally vertical plane transversely of the shaft.

At the upper end of the face a forwardly extending shroud hides the striking face when viewed by the golfer holding the shaft and executing the putting stroke. The striking face is not recessed enough to totally hide the golf ball when putting so the golfer can envisage the position of the ball to be putted, the hidden face ensuring that the golfer will move the face on a straight line through the ball. Thus, the arcuate front edge of the shroud ensures proper placement of the head with respect to the ball. As a result, the center of the striking face will contact the center of the ball to be putted further ensuring the desired travel of the ball in the direction determined by the golfer.

The golf game is so popular that, as an outgrowth, literally hundreds of golfers have attempted to design the best putter. In a foursome, it is not unusual to find four different putters. However, it is believed that none incorporate the shroud over the striking face concept that distinguishes the putter of this invention.

The foregoing features, advantages and benefits of the present invention, along with additional ones, will be seen in the ensuing description and claims which should be considered in conjunction with the accompanying drawings wherein like reference numerals designate like parts. The drawings disclose presently preferred embodiments of the invention in accordance with the best mode presently contemplated for carrying out the invention.

DETAILED DESCRIPTION OF THE DRAWINGS

DETAILED DESCRIPTION OF THE PREFERRED EMBODIMENT

Figure 1:
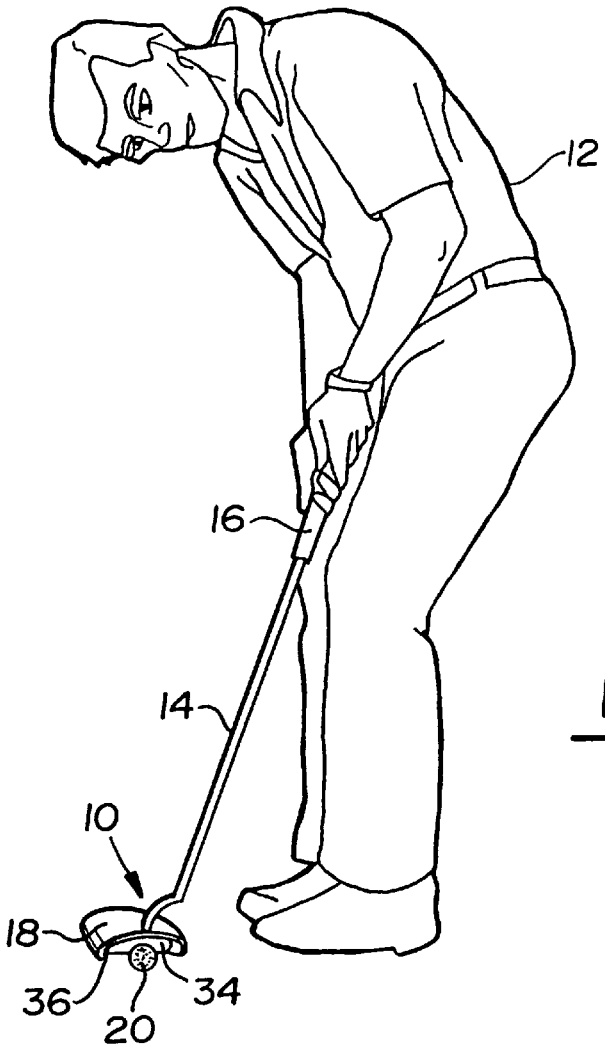
FIG. 1 is a perspective view of the putter of this invention in position and a golfer poised to strike a golf ball with the putter.
Figure 2:
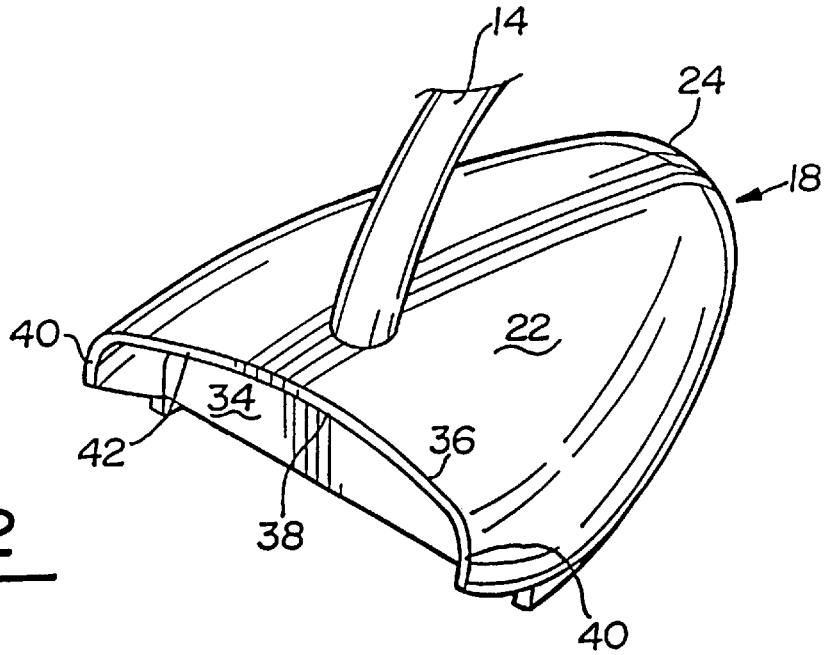
FIG. 2 is an enlarged perspective view of the head in the putter of this invention.
Figure 3:
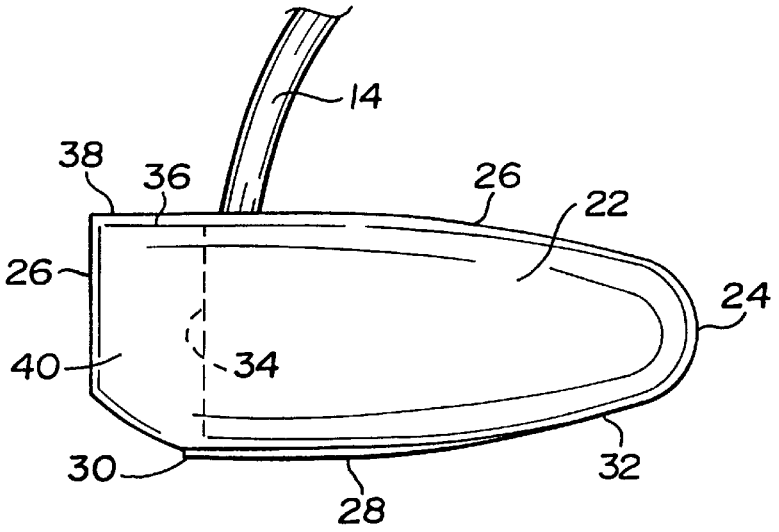
FIG. 3 is a side view of the head shown in FIG. 2.

With reference to the drawing, the putter of this invention, indicated generally at 10, is shown in FIG. 1 in the hands of a golfer 12 standing in position to execute a putting stroke with the putter 10. The putter 10 includes an elongated shaft 14 having a grip section 16 at the upper end of the shaft 14 and a head 18 at the lower end poised to strike a golf ball 20.

The head 18 consists of an integral metal body 22 which is elongated in a direction from its rear end 24 to its front end 26. The body 22 has a contoured top surface and a bottom surface which includes a relatively flat section 28 near the front end of the body 22 and an upwardly inclined section 30 which terminates at the rear end 24 of the body 22.

At its front end 26, the head includes a substantially vertical planar striking face 34, the function of which is to strike the golf ball 20 during the execution of the putting stroke. The body 22 further includes a shroud 36 which extends forwardly from the top of the striking face 34. The shroud 36 has a top section 38 and side sections 40. The top section 38 extends forwardly and terminates in an arcuate edge 42.

On its bottom surface 28, the body 22 is provided with a pair of guide rails 43 arranged in a V-pattern with the rails 43 diverging from the rear end 24 of the body in directions extending to the ends of the striker face 34.

Figure 4:
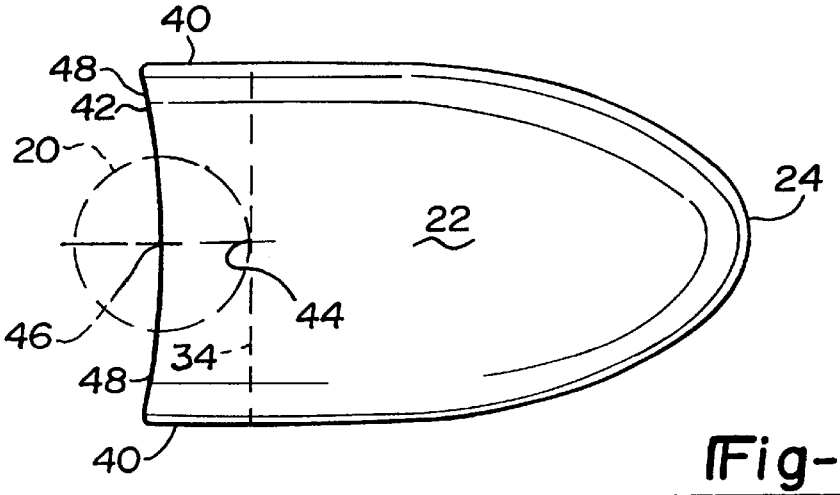
FIG. 4 is a top view of the putter head of this invention.
Figure 5:
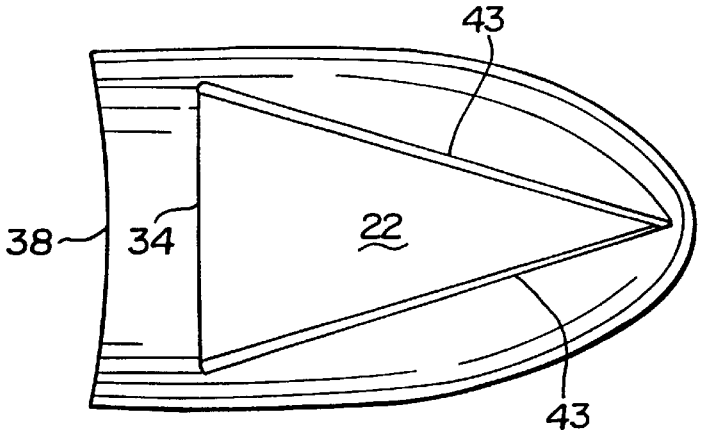
FIG. 5 is as bottom view of the putter head.

In the use of the improved putter 10, assume that the golfer 12 is in the position shown in FIG. 1 and that the putter 10 is in a position in which the ball 20 is touching the striking face 34 as shown in FIGS. 1 and 4. Further assume that the ball 20 is centered on the face 34, the absolute center or sweet spot indicated at 44 in FIG. 4. In a preferred embodiment of the invention, the center 46 of the golf ball is midway between the side sections 40 of the shroud 36. In a preferred embodiment of the invention, the distance between the spot 46 and the face 34 at the point 44 is about seven eights of an inch. The shroud 36 at its midpoint 46 is about two inches above the rails 43 to insure that the golf ball which is about one and three quarters in diameter can easily move below the top of the shroud 36.

The golfer swings the shaft 14 so as to move the head 18 in a rearward direction. At the conclusion of the back swing, the golfer swings the shaft 14 so as to move the sweet spot 44 into engagement with the ball 20 and continue the movement of the head 18 at least as far forwardly of the head position shown in FIG. 1 as the head 18 was moved rearwardly during the back swing. This motion will keep the sweet spot 44 moving through the entire swing in a line centered with respect to the head 18.

The fact that the arcuate edge 38 has two sections 48 on opposite sides of the midpoint 46, enables the golfer 18 to accurately put the sweet spot 44 in line with the midpoint 46 so as to keep the putter on the line shown in FIG. 4 intersecting both the sweet spot and the center point 46.

As shown in FIG. 4, the portion of the ball 20 that is hidden by the shroud 36 is less than half of the ball 20, namely, about three quarters of an inch. Thus, hiding the sweet spot 44 a significant distance behind the edge 38 tends to discipline the golfer 12 in completing his stroke before lifting his head. The accuracy of the putter is thus enhanced.

It is to be understood that the invention is not limited to the exact construction illustrated and described above, but that various changes and modifications may be made without departing from the spirit and scope of the invention as defined in the following claims.

What is claimed is:

1. A golf putter having an upright shaft and a putter head at a lower end of said shaft for striking a golf ball, said head being comprised of an elongated shaped body having a front end and a rear end and top and bottom surfaces, said front body end terminating in an arcuate edge aligned with and integral with said top surface, said arcuate edge being concave towards the plane containing the striking face, said body having a substantially vertical planar striking face rearwardly of said arcuate edge and constituting a front end of said bottom surface, said striking face being of a height greater than the diameter of the golf ball, said arcuate edge being forwardly of said striking face a distance less than the diameter of a golf ball, thereby insuring that in use of the putter a golfer holding said shaft will not see the face when swinging the shaft so as to strike the ball during movement of the face on a line perpendicular to said face so as to enhance the chances of following through with each putting stroke.

2. The golf putter according to claim 1 wherein said arcuate edge is symmetrically positioned relative to said shaft at said body and is progressively uniformly closer to said shaft and said striking face from its terminal ends to its center so as to assist a golfer using the putter to strike the ball at a point on the striking face aligned with the center of said arcuate edge.

3. The golf putter according to claim 2 including guide rails on said bottom surface extending in a V-formation from substantially the center of the rear end of said body to the ends of said striking face to keep the bottom surface and the striking face above the ground when executing a putting stroke.

4. The golf putter according to claim 3 wherein said arcuate edge has downwardly extending end sections which cooperate with the arcuate edge to complete a shroud.

5. A golf putter having an upright shaft and a putter head at the lower end of the shaft, said head being comprised of a body having a flat striking face extending in a generally vertical plane transversely of said shaft and having at a upper end of the face a forwardly extending shroud to hide the striking face but only part of the golf ball when engaged by a user of the putter during a putting stroke, the shroud terminating at its forward end in an arcuate edge having two sections which extend outwardly from the center of the edge which is aligned with the center of the striking face, said arcuate edge is of arcuate shape and being concave towards the plane containing the striking face when looking down on the body which in plan view, is the view seen by a golfer executing a stroke of the putter, said view enhancing the tendency of the putter in use to perform straight movement through the ball on a straight line with the exact middle of the striking face striking the ball because the arcuate sections meet at a vertical line planar aligned with the middle of the striking face.

* * * * *